United States Patent [19]

Ball et al.

[11] 4,092,970

[45] June 6, 1978

[54] CONTROLLING INTERNAL COMBUSTION ENGINES

[75] Inventors: Gerald Stuart Morris Ball, Didcot; Anthony Walter Andrews, Southampton, both of England

[73] Assignee: Exxon Research and Engineering Company, Linden, N.J.

[21] Appl. No.: 628,510

[22] Filed: Nov. 3, 1975

Related U.S. Application Data

[63] Continuation-in-part of Ser. No. 405,861, Oct. 12, 1973, abandoned, which is a continuation of Ser. No. 184,624, Jun. 1, 1971, abandoned.

[30] Foreign Application Priority Data

| | | |
|---|---|---|
| Jun. 5, 1970 | United Kingdom | 27316/75 |
| May 17, 1971 | United Kingdom | 15261/71 |

[51] Int. Cl.[2] ..... F02B 77/00; F02D 11/08

[52] U.S. Cl. ..... 123/198 D; 123/198 DB; 123/103 B; 123/103 D

[58] Field of Search ..... 123/103 R, 103 D, 103 B, 123/198 D, 198 DB, 142; 137/522, 523, 517, 57

[56] References Cited

U.S. PATENT DOCUMENTS

| | | | |
|---|---|---|---|
| 3,371,634 | 3/1963 | Lalande | 123/198 D |

FOREIGN PATENT DOCUMENTS

| | | | |
|---|---|---|---|
| 39,361 | 10/1909 | Austria | 123/103 R |
| 327,192 | 12/1902 | France | 123/103 R |
| 350,209 | 10/1904 | France | 123/103 R |
| 1,016,247 | 11/1952 | France | 123/198 D |

*Primary Examiner*—Ronald B. Cox
*Attorney, Agent, or Firm*—F. Donald Paris

[57] ABSTRACT

A device for controlling maximum speed and/or acceleration of a diesel engine by means of a spring-loaded valve located upstream on the air inlet manifold. The valve, which normally is open, operates on a pressure differential basis and is designed to close when maximum speed is exceeded. By sending the air flow rate to the engine, the air flow can be shut off when it exceeds a rate corresponding to an excessive engine speed.

20 Claims, 10 Drawing Figures

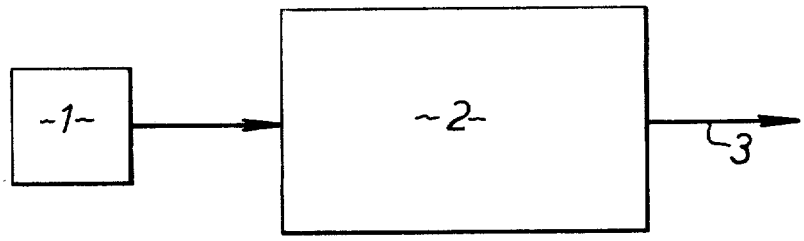
FIG.1A.
FIG.5.
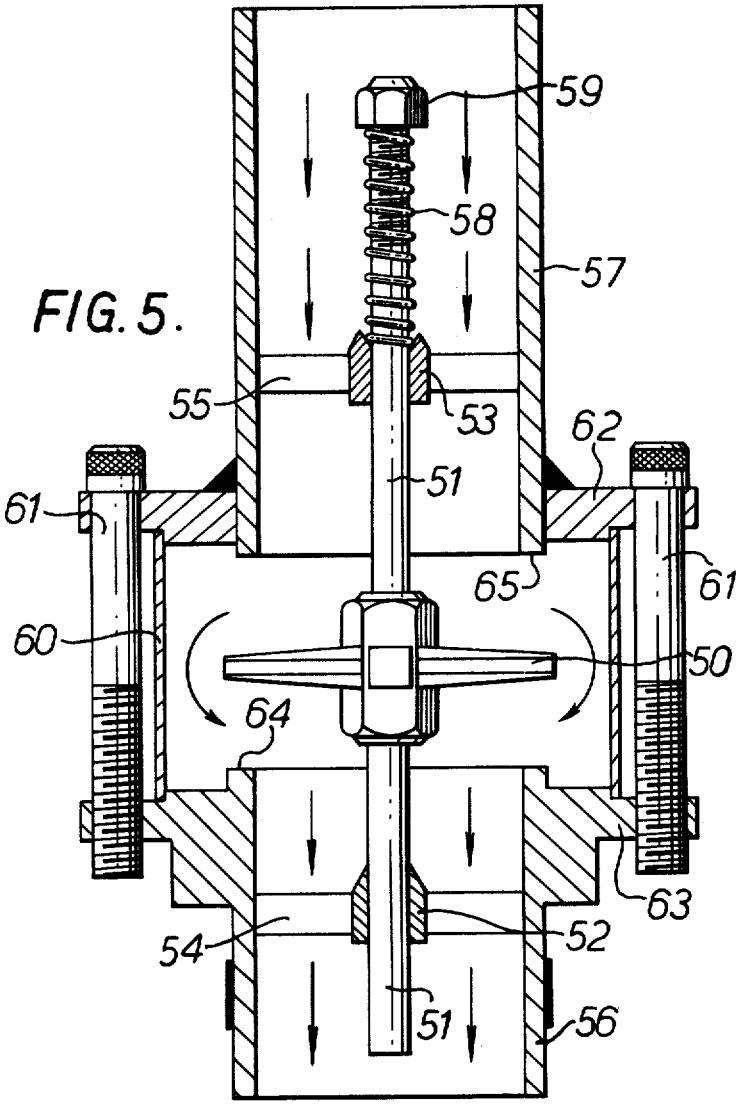

CONTROLLING INTERNAL COMBUSTION ENGINES

CROSS-REFERENCE TO RELATED APPLICATIONS

This is a continuation-in-part of application Ser. No. 405,861, filed Oct. 12, 1973 now abandoned, which is a continuation of Ser. No. 184,624 filed June 1, 1971, now abandoned all of which are incorporated herein by reference.

The present invention relates to controlling internal combustion engines hereinafter abbreviated to (ICE), and more particularly, relates to controlling the desired maximum speed of ICE.

At a particular loading, the speed of an ICE is determined mainly by the amount of fuel-air mixture combusted in the combustion chamber(s) or cylinder(s) thereof. The amount of fuel-air mixture is normally under the control of the operator, but there are certain circumstances in which such control does not wholly, or at all, regulate the fuel-air mixture supplied to the cylinder(s) or combustion chamber(s). In these circumstances, examples of which will be hereinafter given, the speed of the engine may so increase that the engine may be damaged and/or may give rise to more general hazards.

The said circumstances are generally, although not exclusively, characterised by combustible materials entering the cylinders or combustion chamber(s) of an ICE from a source other than the normal fuel supply system of the engine. Thus, with an ICE operating in a chemical works or petroluem refinery, any inflammable gas or vapour from the plant which concentrates in the region of the engine will be drawn into the engine in the air supply thereof: thus the charge of fuel in the fuel-air mixture is increased and the engine will accelerate. Apart from the risk of damage to the engine due to excessive speed, there is also a risk that the flame in the cylinder(s) or combustion chamber(s) of the ICE will flash back through the air intake system and ignite the gas or vapour, possibly causing an explosion.

Other examples of circumstances in which the normal speed control of an ICE can be ineffective are:

in larger marine diesel engine operation when flammable gases or vapours are drawn into the engine room from the ventilating system or in smaller marine engine operation gas leaking from (say) a gas cylinder collects in the bilges.

in the case of road tankers carrying inflammable materials becoming damaged as a result of a road accident or overturning.

in the case of a speed governor of an ICE malfunctioning due, for example, to a broken linkage.

in the case of an overheated and/or overturned ICE in which the sump oil or vapour therefrom is induced into the engine.

in the case of engines having oil-filled air cleaners in which the air-cleaner is overfilled and/or overheated.

Those skilled in the art will probably be aware of other examples of circumstances in which the normal speed control of an ICE becomes relatively ineffective.

The afore-described problem of speed control is particularly associated with compression-ignition engines, but other types of ICE, such as gas turbines and spark-ignited engines, are also susceptible.

The present invention provides a method of controlling an internal combustion engine in which the flow of air or air-fuel mixture to the engine is interrupted when the flow rate thereof is at least equal to a predetermined flow rate.

In another aspect, the invention provides apparatus for controlling an internal combustion engine, the apparatus comprising a conduit portion which forms, or can form, at least part of the air or air-fuel mixture intake conduit of the engine, and means responsive to the rate of air or mixture flow through said portion to obturate or cause the obturation of the said intake conduit therein when the flow rate therethrough is at least equal to a predetermined flow rate.

Said means may comprise a movable valve member capable of moving to a position in which it substantially obturates the conduit portion and thereby substantially prevents air or air-fuel mixture flow to the engine, and biassing means biassing said valve member away from said position.

The valve member may be actuated to move to the said position in response to a signal from a flow-rate sensing device such as a pitot tube or pitot head.

Alternatively, the movably mounted valve member may be disposed in the path of the air or air-fuel mixture so that the flow-rate of air or mixture directly acts on the valve member and initiates or causes its movement to the said position.

The valve member may be in the form of a flap pivotally attached to the conduit portion and which can swing into the air or air-fuel mixture stream or it may be in the form of a plate or piston which moves parallel to the direction of the air or air-fuel mixture flow through the conduit portion.

In a further aspect, the invention comprises the combination of a valve for automatically controlling the maximum speed of an internal combustion engine, a first conduit portion for forming at least part of the intake passageway of said engine and having at least a first valve seat, the minimum internal diameter of the said first conduit and the said first valve seat being D, movably mounted valve means having at least a first sealing surface and operable as a function of pressure differential, support means for mounting said valve means for movement between a normally open position and a closed position, said first sealing surface disposed in operable operation with said first valve seat for substantially sealing off the conduit portion and preventing flow therethrough when said valve means is in its closed position, spring means biasing said valve means into said open position away from said first valve seat, said spring means mounted so that the bias force supplied thereby is in substantially the same direction as the movement of said valve means, said first sealing surface and said first valve seat being spaced apart by a distance L when said valve means is biased to its normally open position, wherein L is at least equal to 0.25D, said spring means and said valve means being constructed and arranged so that when the rate of flow past said valve means is at least equal to a predetermined maximum desired flow rate said valve means automatically moves under influence of the resulting pressure drop thereacross into said closed position in sealed cooperation with said first valve seat in opposition to the bias applied by said spring means, said spring means returning said valve means to said normally open position when the pressure drop across said valve means is substantially zero.

In a further broad aspect, the invention comprises the combination of a valve for automatically controlling the maximum speed of an internal combustion engine, a first conduit portion for forming at least part of the intake passageway of said engine and having at least a first valve seat, the minimum as herein defined internal diameter effective of the said first conduit and the said first valve seat being D, movably mounted valve means having at least a first sealing surface and operable as a function of pressure differential, support means for mounting said valve means for movement between a normally open position and a closed position, said first sealing surface disposed in operable cooperation with said first valve seat for substantially sealing off the conduit portion and preventing flow therethrough when said valve means is in its closed position, spring means biasing said valve means into said open position away from said first valve seat, said spring means mounted so that the bias force supplied thereby is in substantially the same direction as the movement of said valve means, said first sealing surface and said first valve seat being spaced apart by a distance L when said valve means is biased to its normally open position, wherein L is at least equal to 0.25D, said spring means and said valve means being constructed and arranged so that when the rate of flow past said valve means is at least equal to a predetermined maximum desired flow rate said valve means automatically moves under influence of the resulting pressure drop thereacross into said closed position in sealed cooperation with said first valve seat in opposition to the bias applied by said spring means, said spring means returning said valve means to said normally open position when the pressure drop across said valve means is substantially zero.

There may be provided a locking device which maintains the valve member in its flow preventing position once this position is reached. Such a locking device may comprise a mechanical and/or magnetic means for maintaining the said position of the member. The locking device ensures that the engine cannot be re-started without purposeful human intervention to release the valve member once the valve member has moved to its flow preventing position. Without such a locking device, there is a very minor risk (which can be ignored in the majority of cases) that the valve might be opened by reverse flow due to an engine rebound on its compression stroke.

Alternatively, in the type of embodiments of the invention in which the valve member is in the form of a plate or piston which is movable parallel to the direction of flow through the conduit portion, there may be no locking device as aforesaid, but instead the valve member may be normally biassed to a position between two valve seats whereby when the flow rate through the conduit portion is at least equal to the predetermined flow rate, the valve member is moved in the direction of the flow until it cooperates with a downstream one of the valve seats thereby substantially preventing a flow through the conduit portion, and whereby if there should be a reverse flow in the conduit portion due to a rebound of the engine on the compression stroke, the valve member is displaced from the downstream valve seat into cooperation with the upstream valve seat thereby to obstruct the reverse flow, whereby to prevent any tendency to reverse operation of the engine.

There may also be provided a source of an inert or noncombustible gas or vapour having a normally closed valve means which opens either when the flow passage is obturated (e.g. by the movement of the valve member) or when the pressure in the intake conduit falls below a predetermined pressure so that the gas or vapour can pass through the normally-closed valve to the intake conduit. The gas or vapour can serve to mitigate fire or explosion risks and/or prevent damage to the intake conduit (especially in large engines in which the intake conduit is fabricated from sheet metal) which might occur with low pressures therein.

The apparatus of the invention may be detachably attachable to the air or air-fuel mixture intake conduit so that, for example, diesel engine powered air compressors which normally operate in hazard-free environments may be rendered safe for operation in hazardous environments by fitting the apparatus to their air intakes. Alternatively, the apparatus may be a normally permanent part of an air or air-fuel mixture intake system.

Some engines are fitted in engine compartments with insufficient room to accommodate satisfactorily or conveniently the conduit forming part of the air intake which contains the valve and valve-seating: this is particularly the case when it is desired to fit an air or air-fuel flow-control means to an engine which is already installed in its engine compartment. To deal with situations where restricted space could pose problems, the open-biassed valve and its valve-seating may be disposed at the entrance to the intake conduit to the engine.

In the case of diesel engines and other C.I.E.'s, the air which is induced into the engine passes through an air cleaner or filter at the entrance to the air intake conduit to remove solid particles which would abrade the relatively moving parts of the engine. Similar air cleaners or filters are sometimes provided on industrial gas turbines. In preferred embodiments of the invention, for use where space is restricted, the assembly of the valve and valve-seating is disposed either (1) in the air cleaner or filter and attached (preferably detachably) to the upstream end of the air intake pipe, or (2) the valve and its seating are attached (preferably detachably) to the air cleaner or filter in the path which air induced into the engine must follow.

If there is sufficient space within an existing air filter or cleaner for the assembly comprising the valve and its seating, it may be convenient to adopt expedient (1) described above, while if there is insufficient space, expedient (2) may be adopted and the existing air filter may be replaced by an air filter which incorporates the valve and its seating: the replacement filter need not be larger than the filter it replaces but will be adapted internally or externally for receipt of the valve and it seating. An alternative to the expedients (1) and (2) is to provide the valve and its seating in a unit which can be detachably attached to an external opening on the air cleaner and which forms the sole entrance into the air cleaner and air induction system of the engine.

The invention also includes air and air-fuel induction systems provided with apparatus as hereinbefore described and also engines fitted with such air or air-fuel induction systems.

The invention is now described by way of non-limitative examples only, and with reference to the accompanying drawings in which:

FIG. 1A is a block diagram of an engine in accordance with this invention.

FIG. 5 is a cross-section view through yet another modified form of the part shown in FIG. 1.

Referring first to FIG. 1A, there is shown an air-breathing engine (such as a diesel-type or gas-turbine engine) comprising an air entrance 1, which may comprise an air cleaner and/or a silencer, an air-fuel consuming power-producing unit 2, and an exhaust pipe 3 for waste gases which may include a silencer (not shown).

Figure 1:
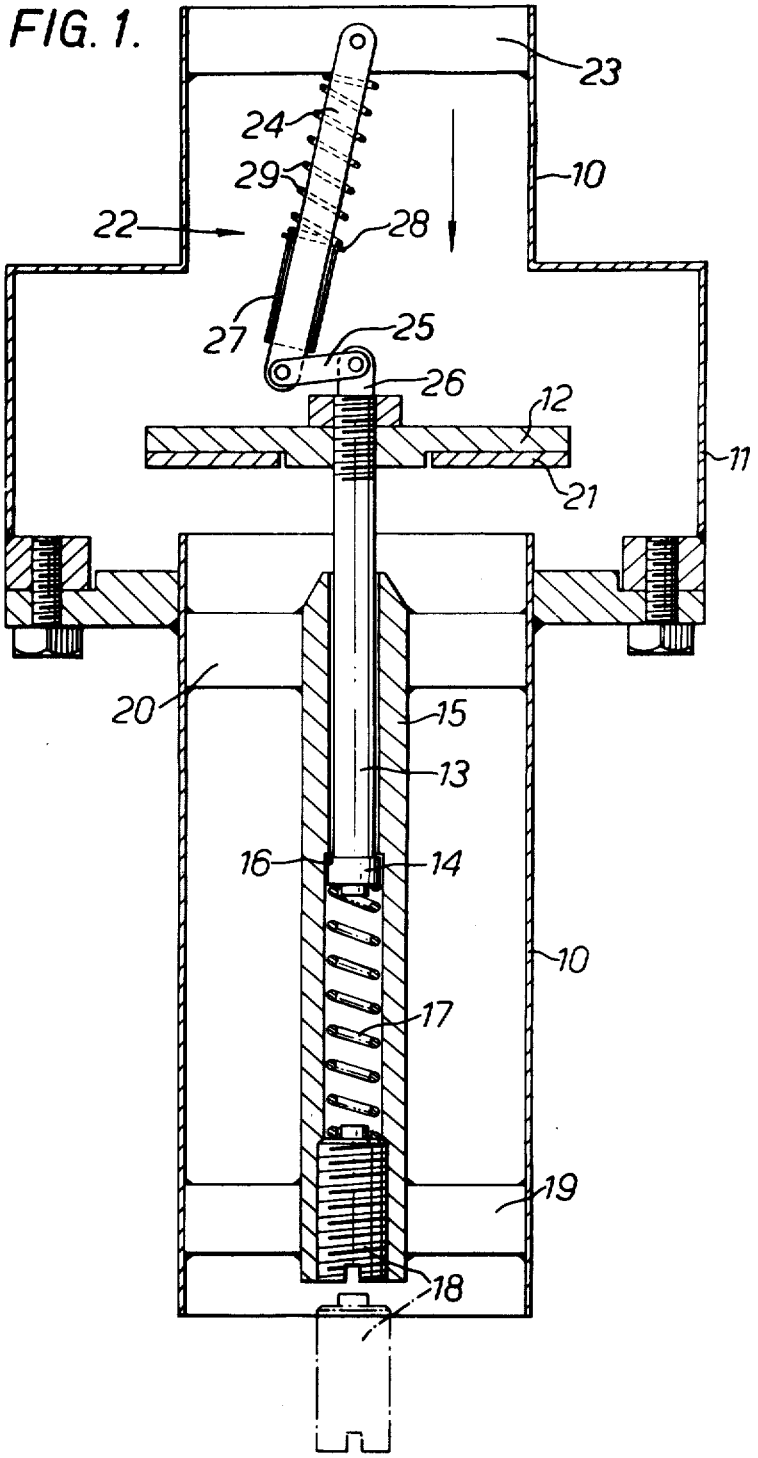
FIG. 1 illustrates part of an air intake system of a diesel-type ICE in accordance with the invention.

In FIG. 1, tube 10 is the air intake tube downstream of the air cleaner (not shown) and upstream of the engine 2, and/or the engine intake manifold (not shown). The tube 10 is divided into an upper and lower part by a valve chamber 11 in which is located movably mounted valve member 12. The valve member 12 is attached to one end of a support rod 13, the other end of which has a portion 14 of enlarged diameter. The support rod 13 is received in a support tube 15 which has a lower portion of larger internal diameter than the internal diameter of the upper portion, so that an internal shoulder 16 is provided which limits the upward travel of the enlarged portion 14 of the support rod 13 (and hence, of the valve member 12). A spring 17 is located in the lower portion of support tube 15 and the compression in the spring 17 is regulated by a grub screw 18 (shown removed, in FIG. 1, for clarity).

The support tube 15 is fixedly disposed substantially axially within the tube 10 by axially spaced spiders 19 and 20.

The diameter of the valve member 12 is greater than the diameter of the tube 10, and when the rate of air flow to the engine (downwards, as shown in FIG. 1) is so great that the pressure drop on valve member 12 produces a downward force exceeding the resultant upward bias of the spring 17, the valve member 12 moves downwardly until its underside contacts and obturates the upper end of the lower portion of the tube 10. When this happens, the flow of air to the engine is substantially interrupted, and the engine speed rapidly falls and the engine stops. The underside of the valve member may be provided with a ring 21 of rubber or other deformable material to improve the prevention of air flow.

If it is desired to maintain the valve member 12 in the air flow prevention position even after the engine speed has dropped, a locking device may be provided. In FIG. 1, the locking device is generally indicated by reference 22 and comprises a spider 23 in the upper part of the tube 10, a tubular linkage 24 pivoted at one end to the spider 23 and to one end of a lever 25 at the other; the other end of the lever 25 is pivoted to an extension 26 of the support rod 13. A tube 27 is disposed on the linkage 24 and the tube 27 has a shoulder or flange 28 at its upper end: a compression spring 29 acts against the flange 28.

When the valve member 12 has moved downwardly to interrupt the flow of air through tube 10, the linkage 24 and lever 25 become substantially aligned with the extension 26 of the support rod 13, and the tube 27 is urged downwardly by the spring 29 to maintain the alignment by enclosing the lever 25, the extension 26 and the lower end of the linkage 24. The valve member 12 is thus maintained in its closure position until the tube 27 is lifted upwards: this can be effected manually through a suitable access aperture or by means of a mechanical linkage (not shown).

When the engine is of such large size that the inlet manifold is a conduit fabricated from sheet metal, there is a risk that after the air flow has been interrupted, the momentum of the engine will lead to a rapid exhaustion of the air in the conduit and a concomitant reduction of pressure, and the pressure can fall to such low values that the sheet metal walls of the conduit will buckle or even rupture. To avoid this risk, a bottle or cylinder (not shown). of an inert gas such as $CO_2$ or a flame preventing vapour such as a chlorinated hydrocarbon can be connected to the intake system at any convenient point through a normally closed valve (not shown). If the latter valve is of the poppet type, it may be arranged to open when the pressure in the intake falls at least to a selected low pressure which is greater than the pressure at which damage to the manifold can occur. Alternatively, the valve may be opened by a mechanical, electrical or fluid-actuated signal or linkage (not shown) derived from the aforedescribed movement of the valve member 12. The opening of the normally-closed valve following closure of the air intake tube 10 by the valve member 12 may be effected in any manner; many ways will be immediately apparent to those skilled in the art, and will therefore not be described herein. In smaller engines, it may still be useful to adopt the above expedient simply for the purpose of purging the inlet manifold and possibly the engine of flammable vapours or gases.

Figure 2:
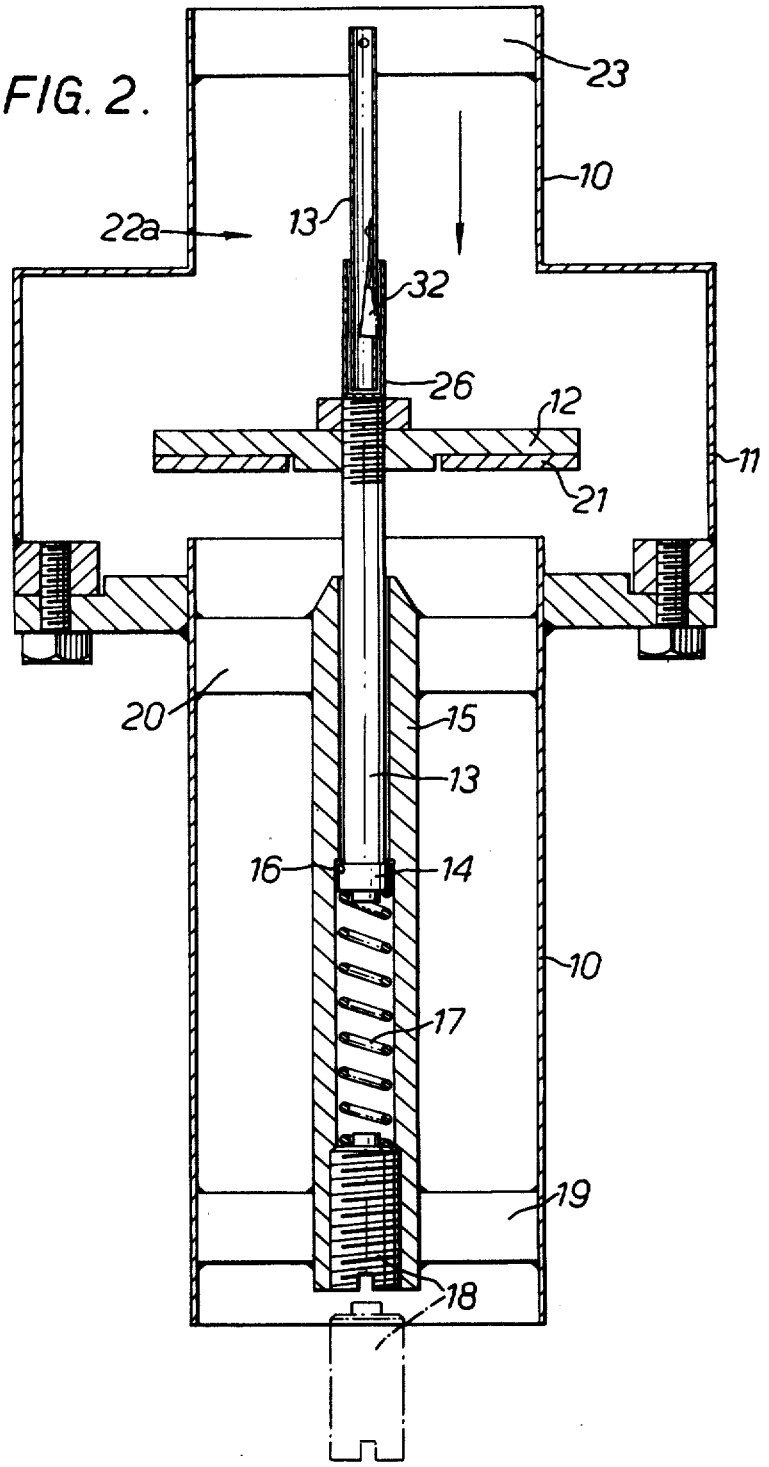
FIG. 2 shows a modified portion of the part shown in FIG. 1.

In FIG. 2, an alternative form of locking device 22*a* is shown. In this form, the extension 26 of support rod 13 is in the form of a short tube, and a rod 31 fixedly located in the tube 10 by, say, a spider (not shown) extends into the tubular extension 26. The rod 31 is provided with an umbrella type spring lock 32. When the valve member 12 has moved down to its air-interrupting position, the spring lock 32 is clear of the top of the tubular extension 26 and is able to spring open, thus maintaining the extension 26 and the valve member 12 in the air-interrupting position.

Figure 3:
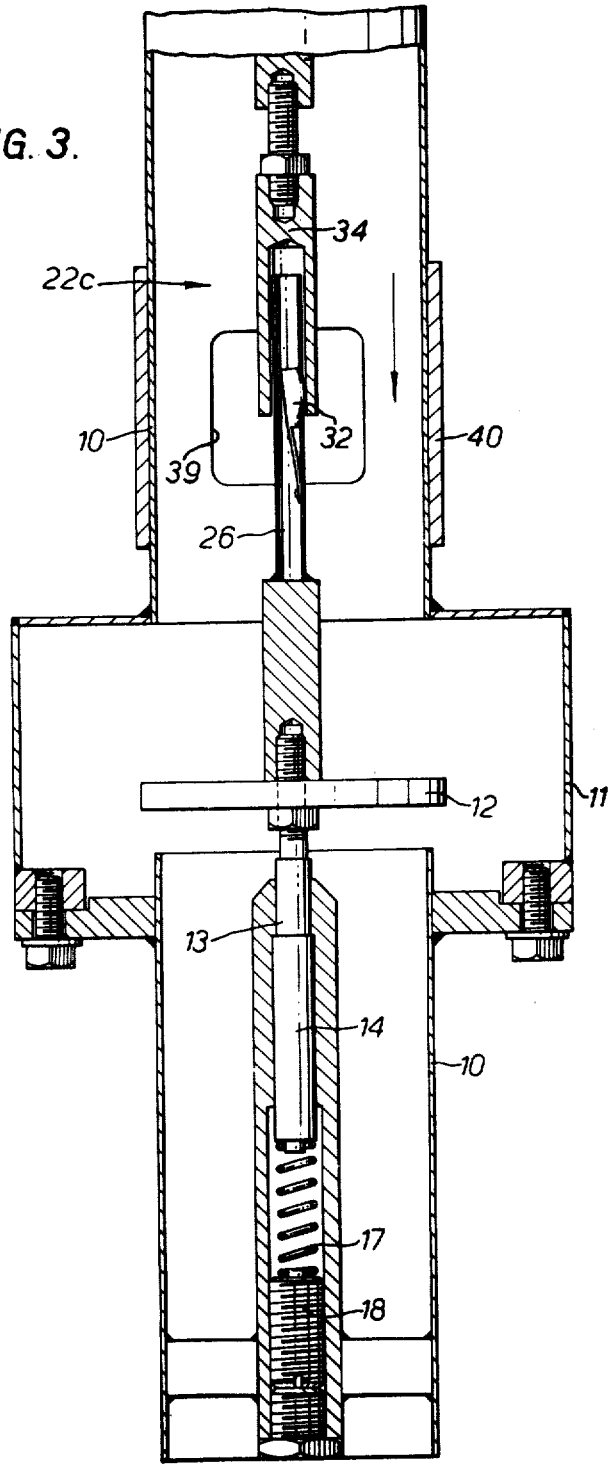
FIGS. 3 and 4 show another type of modification of the part of FIG. 2 respectively in the open and closed positions of a valve member.
Figure 4:
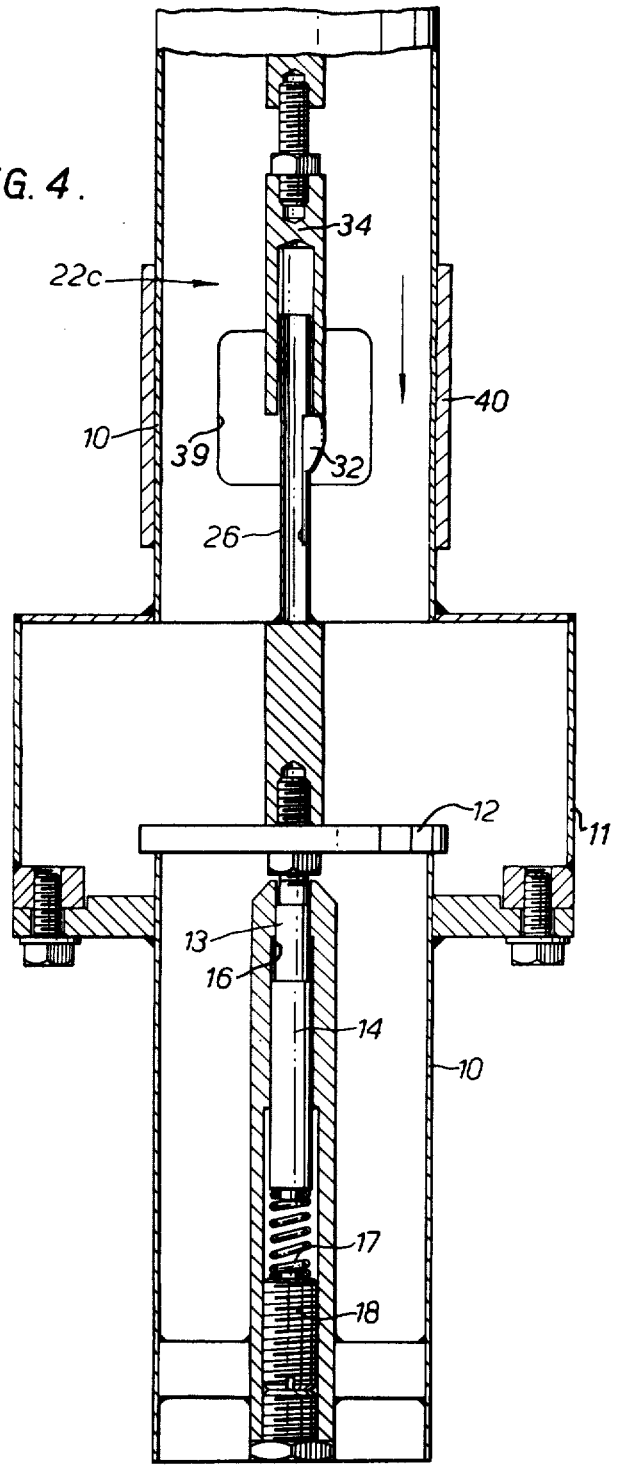

In FIGS. 3 and 4, the locking device is generally indicated by reference 22*c*, and resembles the locking device 22*a* of FIG. 2 except that the umbrella-type spring lock 32 is located on and recessible in the extension 26 of support rod 13: as will be seen from FIGS. 3 and 4, the extension 26 is received at its upper (as depicted) end in a bore at the lower (as depicted) end of a rod 34. The rod 34 is centrally mounted in the air intake tube 10 by a spider (not shown).

When the air flow rate to the engine is less than that necessary for maximum speed operation, the valve member 12 is maintained clear of the upper end of the lower part of tube 10 by the compression in the spring 17. In this position of the valve member 12, the spring lock 32 is within the bore of the rod 34.

However, when the air flow-rate exceeds that required for maximum engine speed, the resultant downward movement of the valve member 12 into contact with the top of the lower part of tube 10 enables the spring lock 32 to open on reaching the bottom of the bore in rod 34, as shown in FIG. 4: the valve member 12 is then locked in its obturating position.

The valve member 12 can be manually released from the position shown in FIG. 4 by access through an aperture 39 in the upper part of the tube 10. The aperture 39 is large enough to enable an operative's hand to reach the lock 32 and spring it back into the bore in rod 34, upon which the thrust of the spring 17 will raise the valve member 12 to the position shown in FIG. 3.

The aperture 39 is normally closed by a surrounding sleeve 40, and access to the aperture may be achieved by sliding the sleeve 40 along the tube 10 away from the valve chamber 11, or alternatively, there may be an aperture (not shown) in sleeve 40 which can be brought into register with the aperture 39 by rotation of the sleeve 40.

Reference is now made to FIG. 5 which shows an embodiment devoid of means for locking the valve member in its obturating position but which is provided with sealing faces on both sides which are cooperable with valve seatings spaced apart from each sealing face.

Although this embodiment does not lock in its obturating position, it is adapted that temporary increases in manifold pressure caused from a rebound of the engine from a compression stroke, and any consequential operation of the engine in reverse due to inspiration air and flammable material from, e.g., the exhaust manifold, can be accommodated.

In FIG. 5, the valve member 50 is double faced and is mounted on a guide rod 51 which extends on both sides of the member 50 to be slidably received in respective guide sleeves 52, 53 at each end, the guide sleeve being located by respective spiders 54, 55 in respective air conduit portions 56, 57 on each side of the valve member 50. A spring 58 to provide a biassing force on the valve member 50 during operation is located between the upstream guide sleeve 53 and a locking nut 59 on the most upstream part of the guide rod 51. The valve member 50 is disposed in a chamber having walls 60 of greater internal diameter than the internal diameter of the conduit portions 56, 57 and a number of bolts 61, of which two are shown in FIG. 5, maintain the integrity of the parts of the assembly by joining annular flanges 62, 63 of the upstream and downstream conduit portions 57, 56. In operation, an excess flow of air through the assembly of FIG. 5 causes the valve member 50 to move downstream into contact with a valve seat 64 formed by a part of conduit portion 56, thereby substantially preventing the passage of air into the air intake conduit of the engine 2, and thereby stopping the engine 2. As a safeguard against the engine rebounding from a compression stroke and starting in the reverse direction, a valve seat 65 is provided by a projecting part of the upstream conduit portion 57 so that such rebound by the engine will cause the valve member 50 to move upstream direction, and to seal against the upstream valve seat 65 thereby preventing the engine from receiving or exhausting any gases or vapour during reverse running.

Figure 6:
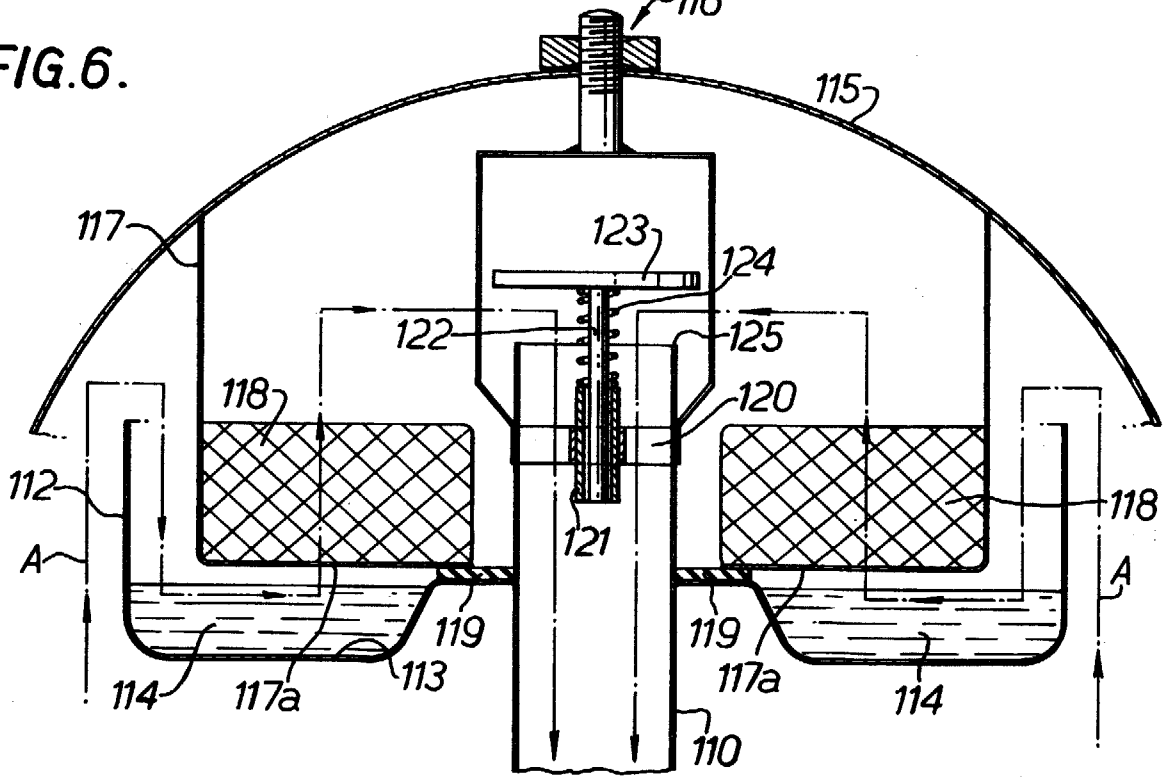
FIG. 6 is a diagrammatic cross-sectional elevation through a representative or typical air cleaner for a diesel engine, but modified in accordance with the invention.

Referring now to FIG. 6, the air-intake pipe of the engine is indicated by reference 110 and the top of the intake pipe 110 terminates within the air cleaner, indicated generally by reference 111.

The air cleaner 111 comprises a base 112 which fits in substantially air-tight fashion around the pipe 110 and incorporates an annular well portion 113 in which a layer 114 of heavy oil is disposed. The cleaner 111 also comprises a domed top 115 which is attached either to the base 112 or to the intake pipe 110, e.g. by means of a bolt and nut arrangement 116, the full details of which are not shown since many modes of effecting this attachment will be apparent to those skilled in the art. The domed top 115 comprises an internal wall 117 which extends downwardly and radially inwardly above the annular well portion 113, the inwardly extending part **117*a* being apertured and supporting an annular ring 118 of wire gauze (or other suitable filter material). The downwardly extending part of the wall 117 is spaced from a corresponding upwardly extending part of the base 112 when the cleaner is correctly assembled whereby to provide an annular opening through which air can pass into the cleaner 111, while the radially-inwardly extending part 117*a* makes substantially air-tight contact with the base 112 inwardly of the well portion 113: as depicted, there may be provided an annular gasket 119 between the inner parts of the wall part 117*a* and the base 112 to serve as an air-seal. It will be appreciated from the foregoing description that air induced by the suction of the engine 2 acting via the air-intake pipe 110 enters the cleaner 111 between the outer walls of the base 112 and the dome top 115 passes through the layer of oil 114 in the well portion 113 and then upwardly through the apertured wall portion 117*a* and gauze 118 before entering the top of the intake-pipe 110**, the path of the air being indicated by the arrowed lines A.

Mounted within the intake pipe 110 near to its top end is a support spider 120: The spider may be secured in position by screws (not shown) which register in recesses and/or with apertures (not shown) in the spider 120 and the pipe 110. The spider 120 supports a vertical annular tube 121 in which a guide rod 122 can move up and down. At the top of the guide rod is a valve member 123 in the form of a piston, and between the underside of the piston 123 and the top of the tube 121 is trapped a coil spring 124 biassing the piston 123 upwards and away from the top of the intake pipe 110. The coil spring is under compression and the force exerted by the spring may be varied by any convenient means such as a lock-nut (not shown) above or below the spring. The top edge 125 of the intake pipe 110 is so formed that it can co-operate with the underside of the piston 123 to form a substantially air-tight seal.

The operation of the embodiment of FIG. 6 is as follows:

When the compression in the spring is correctly adjusted, air induced into the intake pipe 110 during the working of the engine will cause a pressure drop across the piston 123 and thus a corresponding downward force on the piston. When the rate of air-flow to the intake pipe 110 is substantially equal to the air-flow rate corresponding to the maximum desired speed of the engine, the pressure-drop across the piston is sufficient to move the piston against the bias provided by the spring 124 until the underside of the piston 123 is forced against the top edge 125 of the intake pipe 110 thereby to seal the intake pipe and to cause the engine to stop due to lack of air for combustion.

Figure 7:
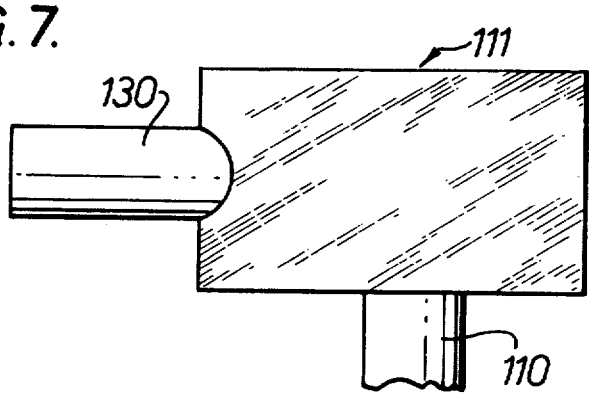
FIG. 7 is an external view of a type of air cleaner for a diesel engine.

The air cleaner 111 depicted in FIG. 7 is of the type having an orifice defined by a spout 130 which constitutes the entrance to the air cleaner 111 and to the intake pipe 110.

Figure 8:
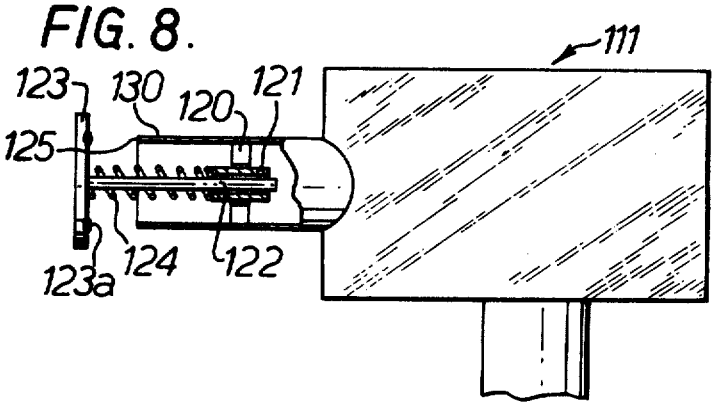
FIG. 8 shows the air cleaner of FIG. 7 modified in accordance with the invention.

FIG. 8 illustrates an simple adaption of the air-cleaner of FIG. 7 for control of the maximum air-flow into the spout 130. The same types of items of hardware are employed in the flow control valve in this embodiment as in the embodiment of FIG. 6 and the like reference numerals designate like items.

In FIG. 8, the nose 125 of the spout 130 forms the valve seating, and within the spout 130 is disposed and fixedly located a spider 120 which supports a guide tube 121 in which a guide rod 122 can move in the axial direction of the spout. Outwardly of the spout 130 is a valve member 123 in the form of a piston, and between the valve member 123 and the guide tube 121 is a coil spring 124 under compression. The compression in the spring 124 is determined by the adjustment of a lock-nut (not shown) which may be disposed either between the valve member 123 and the spring 124 or between the spring 124 and the guide tube 121. The face of the valve member 123 opposite the nose 125 may be provided with a ring 123*a* of deformable material, such as rubber, so that when the air flow into the spout 130 attains the maximum desired value and causes the valve member 123 to move against the force of the spring 124 into contact with the nose 125, an adequately air-tight seal is formed across the opening to the air cleaner 111 to prevent operation of the engine.

The embodiment described in relation to FIG. 8 has the merit of simplicity and enables air-cleaners of the type shown in FIG. 7 to be quickly adapted for safe use in areas in which flammable vapours could be present.

Figure 9:
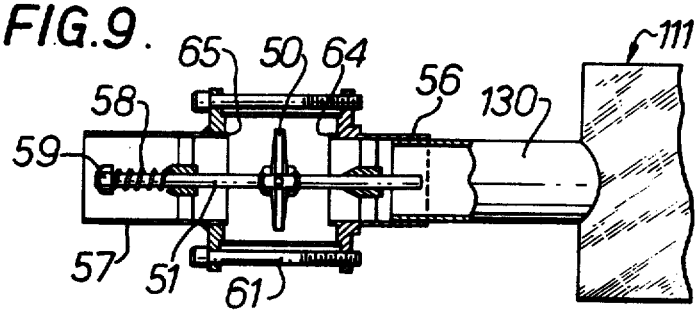
FIG. 9 shows the air cleaner of FIG. 7 using the assembly of FIG. 5 as an alternative to the type of modification shown in FIG. 8.

Another embodiment which can equally well be applied to air-cleaners of the type shown in FIG. 7 is illustrated in FIG. 9 in which the part illustrated in FIG. 5 is fitted on or over the spout 30 in any convenient air-tight fashion.

The manner of operation of the part shown in FIG. 5 has already been described hereinabove, and since the operation in combination with the air-cleaner of FIG. 7 will be the same as described in relation to FIG. 5, there is no necessity to describe again the mode of operation.

The features hereinabove described may be employed in various combinations other than those specifically mentioned without departing from the invention as defined by the appended claims.

It is important, generally speaking, at least from the point of view of the operator, that the apparatus should not cause a reduction of any significance in the performance of the engine with which it is used. In the case of compression-ignition engines and other engines whenever the fuel is injected, the engine should not produce significantly more smoke when used with the apparatus of the engine than when used without.

In order to avoid significant de-rating of engine performance, and to avoid significant increases in smoke during operation, the following general rough or rule-of-thumb guide may be followed: if the normal distance of the valve member's downstream face from its downstream seating (e.g. 64 in FIG. 5 and 125 in FIG. 6) is L, then L must be at least equal to D/4, where D is the internal diameter of the downstream conduit portion (e.g. 56 in FIG. 5 and 110 in FIG. 6). In embodiments wherein the valve member is surrounded by a valve chamber (e.g. 11 in FIG. 1 and 60 in FIG. 5) of diameter $D_2$ and wherein the valve member has a diameter of $D_1$, $D_2$ must be at least equal to the square root of the sum of $D^2$ and $D_1^2$.

In a more accurate guide to the dimensions of the apparatus of the invention, the dimensional relationships set out below may be observed. In these relationships, the symbols employed have the following meaning:

*Dci* = mininum diameter (or effective diameter as defined below) of part of air inlet conduit upstream of the apparatus (this part will be incorporated in most engines using apparatus of the type shown in FIGS. 1 to 5, and in some instance, in FIG. 9).

*Dco* = minimum diameter (or effective diameter as defined below) of part of air inlet conduit downstream of the apparatus.

*Dei* = effective diameter (as defined below) of the upstream conduit portion of the apparatus (e.g. portion 57 in FIG. 5).

*Deo* = effective diameter (as defined below of the downstream conduit portion of the apparatus (e.g. portion 56 in FIG. 5 and portion 110 in FIG. 6).

*Dsi* = internal diameter (or effective diameter) of upstream valve seat (e.g., seat 65 in FIG. 5).

*Dso* = internal diameter (or effective diameter) of downstream valve seat (e.g. seat 64 in FIG. 5 and 125 in FIG. 6).

$D_2$ = diameter of the valve chamber (e.g. 60 in FIG. 5)

H = axial length of the valve chamber between the planes of the valve seats.

$D_1$ = diameter of the valve member (e.g. 50 in FIG. 5)

*t* = thickness or effective thickness (as defined below) of the valve member in the region where the valve member abuts the valve seat(s) during operation of the apparatus.

$L_1$ = distance between the upstream valve seat and the cooperable region of the upstream face of the valve member.

$L_2$ = distance between the downstream valve seat and the cooperable region of the downstream face of the valve member.

C = a coefficient.

In the foregoing list of symbols, the qualification "effective" means the dimension that the item appears to have when in use in the apparatus in an engine. Thus, in the assemblies shown in FIGS. 5 and 6, the effective diameters (Deo) of the conduit portions 56 and 110 respectively are less than the actual diameter since part of the flow area is occupied by parts such as support spiders and guide rods, and these items, moreover, impede the flow of air to some extent so that the flow area appears to be less than the area which is calculatable or measurable from the dimensions of the parts. The effective diameter, Deo, may be determined either experimentally or by one of the adequately accurate methods of calculation well known to those skilled in the art. A common mode of calculation is to determine the "hydraulic diameter", $D_h$, which is 4 × unobstructed flow area, divided by the total perimeter of the unobstructed flow area. The calculated hydraulic diameter is then multiplied by a coefficient C to compensate for the impedance to flow caused by the flow-obstructing items. The actual value of the coefficient C will depend upon the shape of the items, but values of C are known for most situations of this type, and are usually in the range of from 0.50 to 0.99, more usually in the range of from 0.55 to 0.75, and most usually in the range of from 0.60 to 0.70. Thus, Deo will be $C \times D_h$ (approximately) and C is likely to have a value of about 0.65.

For all of the embodiments of the invention, it is preferred that at least some of the following relationships are followed:

$$D_1 > Dso \quad (1)$$

Preferably, $D_1$ has a value of from 1.05 Dso to 1.20 Dso.

$$Deo \geqq Dco \quad (2)$$

$$L_2 \geqq Deo/4 \quad (3)$$

In those embodiments of the invention wherein the valve member is surrounded by a valve chamber (e.g. FIG. 1) it is preferred that the following relationship is followed.

$$D_2 \geqq C_1 (Deo^2 + D_1^{\,2})^{\frac{1}{2}} \quad (4)$$

Where $C_1$ is a coefficient as described above. In most instances $C_1$ will have a value of from 0.6 to 0.7, but higher values can be obtained by suitable shaping of the valve member.

In these embodiments of the invention wherein there is an upstream valve seat against which the upstream face of the valve member can cooperate (e.g. FIG. 5), it is preferred that at least some of the following relationships are followed:

$$D_1 > Dsi \quad (5)$$

Preferably, $D_1$ has a valve of from 1.05 *Dsi* to 1.20 *Dsi*

$$Dei \geqq Dci \quad (6)$$

$$L_1 \geqq Dei/4 \quad (7)$$

$$D_2 \geqq C_2 (Dei^2 + D_1^{\,2})^{\frac{1}{2}} \quad (8)$$

Where $C_2$ is a coefficient as described above which, in most instances will have a value in the range of from 0.6 to 0.9, and more particularly 0.6 to 0.8.

In embodiments such as FIG. 5, the following relationship will be followed:

$$H = L_1 + L_2 + t \quad (9)$$

and it follows, by substituting from equations (3) and (7) that:

$$H - t \geqq (Dei + Deo)/4 \quad (10)$$

We claim:

1. A valve in combination with an internal combustion engine for automatically controlling the maximum speed of said engine, a first conduit portion forning at least part of the intake passageway of said engine and having at least a first valve seat, the maximum internal diameter of the said first conduit portion and the said first valve seat being D, movably mounted valve means having at least a first sealing surface and operable as a function of pressure differential, support means for mounting said valve means for movement between a normally open position and a closed position, said first sealing surface disposed in operable contact with said first valve seat for substantially sealing off said first conduit portion and preventing flow therethrough when said valve means is in its closed position, spring means biasing said valve means into said open position away from said first valve seat, adjusting means for adjusting the amount of bias supplied by said spring means to said valve means and being substantially inaccessible when operatively assembled with said engine, said first sealing surface and said first valve seat being spaced apart by a distance L when said valve means is biased to its normally open position, wherein L is at least equal to 0.25D, said spring means and said valve means being so constructed and arranged and the bias of said spring means being so adjusted that when the rate of flow past said valve means is at least equal to a predetermined maximum desired flow rate corresponding to a maximum desired engine speed said valve means automatically moves under influence of the resulting pressure drop thereacross into said closed position in sealed contact with said first valve seat in opposition to the bias applied by said spring means for stopping said engine, said spring means returning said valve means to said normally open position when the engine is stationary and the pressure drop across said valve means is substantially zero.

2. The combination of claim 1 wherein said first valve seat comprises an extremity of said first conduit portion and said valve means is located externally of said first conduit portion for movement between said normally open position spaced from said extremity of said conduit portion and said closed position in operable sealed contact with said first valve seat.

3. A valve in combination with an internal combustion engine for automatically controlling the maximum speed of said engine comprising, a first conduit portion forming at least part of the intake passageway of said engine and having at least a first valve seat arranged in a plane perpendicular to the length of said first conduit portion, movably mounted valve means having at least a first sealing surface arranged in a plane perpendicular to the length of said first conduit portion and opposite said first valve seat, a chamber surrounding said valve means and having a diameter exceeding that of said first valve seat, support means operably connected with said first conduit portion for mounting said valve means for movement in said chamber between a closed position wherein said first sealing surface abuts said first valve seat to close off the first conduit portion and thereby prevent flow therethrough and an open position wherein said first valve seat and said first sealing surface are separated by a predetermined distance, said distance being at least 0.25 times the minimum diameter of said first conduit portion including said first valve seat, spring means biasing said valve means in the direction perpendicular to the plane of said first sealing surface away from said closed position and into said open position in said chamber so that said first valve seat is separated from said first sealing surface, said spring means and said valve means being so constructed and arranged and the bias of said spring means being so adjusted that when the rate of flow past said valve means is at least equal to a predetermined maximum desired flow rate corresponding to a maximum desired engine speed said valve means automatically moves under influence of the resulting pressure drop thereacross into said closed position and into abutment with said first valve seat in opposition to the bias applied by said spring means for stopping said engine, said spring means returning said valve means to said open position when the engine is stationary and the pressure drop across said valve means is substantially zero and adjusting means for adjusting the amount of bias applied by said spring means to said valve means and being substantially inaccessible when operatively assembled with said engine.

4. The combination of claim 3 wherein said support means comprises a stationary support member including a central guideway coaxial with said first conduit portion, and a moveable support rod having a first end slidably and coaxially mounted in said support member and the other end supporting said valve means and protruding axially out of said first conduit portion, said spring means being located within said guideway and one end thereof abutting said support rod and the opposite end thereof abutting said guideway.

5. The combination of claim 3 in which the valve means comprises plate means mounted in said chamber for movement substantially parallel to the direction of flow through said first conduit portion.

6. The combination of claim 5 comprising a locking device which is operative to releasably maintain said valve means substantially in said closed position.

7. The combination of claim 3 in which said valve means is provided with a second sealing surface opposite said first sealing surface, said valve means located between an upstream valve seat comprising a second valve seat and a downstream valve seat comprising said first valve seat with which a respective one of said first and second sealing surfaces can engage to block flow through said first conduit portion.

8. A valve in combination with an internal combustion engine for automatically controlling the maximum speed of said engine, a first conduit portion forming at least part of the intake passageway of said engine and having at least a first valve seat, movably mounted valve means having at least a first sealing surface and operable as a function of pressure differential, said valve means having a mean diameter $D_1$ and said first conduit including said first valve seat having a minimum internal diameter D, support means for mounting said valve means for movement between a normally open position and a closed position, said first sealing surface disposed in operable sealed contact with said first valve seat for substantially sealing off the first conduit portion and preventing flow therethrough when said valve means is in its closed position, a chamber surrounding said valve means, spring means biasng said valve means into said open position away from said first valve seat, said chamber having a mean internal diameter $D_2$, wherein the value of $D_2$ is substantially equal to at least the square root of $D^2 + D_1^2$, said first sealing surface and said first valve seat being spaced apart by a distance L when said valve means is biased to its normally open position, wherein L is at least equal to 0.25D, said spring means and said valve means being so constructed and arranged and the bias of said spring means being so adjusted that when the rate of flow past said valve means is at least equal to a predetermined maximum desired flow rate corresponding to a maximum desired engine speed said valve means automatically moves under influence of the resulting pressure drop thereacross into said closed position in sealed abutting contact with said first valve seat in opposition to the bias applied by said spring means for stopping said engine, said spring means returning said valve means to said normally open position when the engine is stationary and the pressure drop across said valve means is substantially zero and adjusting means for adjusting the amount of bias applied by said spring means to said valve means and being substantially inaccessible when operatively assembled with said engine.

9. A valve in combination with an internal combustion engine for automatically controlling the maximum speed of said engine, a first conduit portion forming at least part of the intake passageway of said engine and having at least a first valve seat, the said first conduit portion including the said first valve seat having a minimum internal diameter D, movably mounted valve means having at least a first sealing surface and operable as a function of pressure differential and having a mean diameter $D_1$, support means for mounting said valve means for movement between a normally open position and a closed position, said valve means including a second sealing surface opposite said first sealing surface, said valve means being located between an upstream valve seat and a downstream valve seat comprising said first valve seat with which a respective one of said first and second sealing surfaces can engage to block flow through said first conduit portion, said first sealing surface disposed in operable sealed contact with said first valve seat for substantially sealing off the first conduit portion and preventing flow therethrough when said valve means is in its closed position, a chamber surrounding said valve means, said chamber having a means internal diameter $D_2$ wherein the valve of $D_2$ is substantially at least equal to the square root of $D^2 + D_1^2$, said valve means being mounted to said chamber for movement substantially parallel to the direction of flow through said first conduit portion, said first and second sealing surfaces being spaced a predetermined distance L from a corresponding one of said first and second valve seats when said valve means is biased to its normally open position, wherein L is at least equal to 0.25D, spring means biasing said valve means into said normally open position away from said first valve seat, said spring means and said valve means being constructed and arranged so that when the rate of flow past said valve is at least equal to a predetermined maximum desired flow rate said valve means automatically moves under the influence of the resulting pressure drop thereacross into said closed position in sealed contact with said first valve seat in opposition to the bias applied by said spring means, said spring means returning said valve means to said open position when the pressure drop across said valve means is substantially zero and adjasting means for adjusting the amount of bias applied by said spring means to said valve means and being substantially inaccessible when operatively assembled with said engine.

10. A valve in combination with an internal combustion engine for automatically controlling the maximum speed of said engine, a first conduit portion forming at least part of the intake passageway of said engine and having at least a first valve seat, said first conduit and said first valve seat having a minimum effective internal diameter which comprises the product of a coefficient C having a value in the range of 0.50 to 0.99 multiplied by four times the unobstructed flow area of said first conduit divided by the total perimeter of said unobstructed flow area, said coefficient compensating for the impedance to flow therethrough cause by any flow obstructing items, movably mounted valve means having at least a first sealing surface and operable as a function of pressure differential, support means for mounting said valve means for movement between a normally open position and a closed position, said first sealing surface disposed in operable sealed contact with said first valve seat for substantially sealing off the first conduit portion and preventing flow therethrough when said valve means is in its closed position, spring means biasing said valve means into said open position away from said first valve seat, said spring means mounted so that the bias force supplied thereby is in substantially the same direction as the movement of said valve means, said first sealing surface and said first valve seat being spaced apart by a distance L when said valve means is biased to its normally open position, wherein L is at least equal to 0.25D, said spring means and said valve means being so constructed and arranged and the bias of said spring means being so adjusted that when the rate of flow past said valve means is at least equal to a predetermined maximum desired flow rate corresponding to a maximum desired engine speed said valve means automatically moves under influence of the resulting pressure drop thereacross into said closed position in sealed cooperation with said first valve seat in opposition to the bias applied by said spring means for stopping said engine, said spring means returning said valve means to said normally open position when the engine is stationary and the pressure drop across said valve means is substantially zero.

11. The combination of claim 10 wherein said first valve seat comprises an extremity of said first conduit portion and said valve means is located externally of said first conduit portion for movement between said normally open position spaced from said extremity of said conduit portion and said closed position in operable sealed contact with said first valve seat.

12. A valve in combination with an internal combustion engine for automatically controlling the maximum speed of said engine comprising a first conduit portion for forming at least part of the intake passageway of said engine and having at least a first valve seat arranged in a plane perpendicular to the length of said first conduit portion, movable mounted valve means having at least a first sealing surface arranged in a plane perpendicular to the length of said first conduit portion and opposite said first valve seat, a chamber surrounding said valve means and having a diameter exceeding that of said first valve seat, support means operably connected with said first conduit portion for mounting said valve means for movement in said chamber between a closed position wherein said first sealing surface abuts said first valve seat to close off the first conduit portion and thereby prevent flow therethrough and an open position wherein said first valve seat and said first sealing surface are separated by a predetermined distance, said distance being at least 0.25 times the minimum effective diameter of said conduit portion and said first valve seat said minimum effective diameter comprising the product of a coefficient C having a value in the range of 0.50 to 0.99 multiplied by four times the unobstructed flow area of said first conduit divided by the total perimeter of said unobstructed flow area, said coefficient compensating for the impedance to flow therethrough caused by any flow obstructing items, spring means biasing said valve means in the direction perpendicular to the plane of said first sealing surface away from said closed position and into said open position in said chamber so that said first valve seat is separated from said first sealing surface, said spring means and said valve means being so constructed and arranged and the bias of said spring means being so adjusted that when the rate of flow past said valve means into said first conduit portion is at least equal to a predetermined maximum desired flow rate corresponding to a maximum desired engine speed said valve means automatically moves under influence of the resulting pressure drop thereacross into said closed position and into abutment with said first valve seat in opposition to the bias applied by said spring means for stopping said engine, said spring means returning said valve means to said open position when the engine is stationary and the pressure drop across said valve means is substantially zero.

13. The combination of claim 12 wherein said support means comprises a stationary support member including a central guideway coaxial with said first conduit portion, and a moveable support rod having a first end slidably and coaxially mounted in said support member and the other end supporting said valve means and protruding axially out of said first conduit portion, said spring means being located within said guideway and one end thereof abutting said support rod and the opposite end thereof abutting said guideway.

14. The combination of claim 12 in which the valve means comprises plate means mounted in said chamber for movement substantially parallel to the direction of flow through said first conduit portion.

15. The combination of claim 12 comprising a locking device which is operative to releasably maintain said valve means substantially in said closed position.

16. The combination of claim 12 in which said valve means is provided with a second sealing surface opposite said first sealing surface, said valve means located between an upstream valve seat comprising a second valve seat and a downstream valve seat comprising said first valve seat with which a respective one of said first and second sealing surfaces can engage to block flow through said conduit portion.

17. A valve in combination with an internal combustion engine for automatically controlling the maximum speed of said engine, a first conduit portion forming at least part of the intake passageway of said engine and having at least a first valve seat of diameter $D_s$, movably mounted valve means having at least a first sealing surface and operable as a function of pressure differential, said valve means having a mean diameter $D_1$ wherein $D_1$ is greater than $D_s$ and said first conduit including said first valve seat having a minimum effective internal diameter D which comprises the product of a coefficient C having a value in the range of 0.50 to 0.99 multiplied by four times the unobstructed flow area of said first conduit divided by the total perimeter of said unobstructed flow area, said coefficient compensating for the impedance to flow therethrough caused by any flow obstructing items, support means for mounting said valve means for movement between a normally open position and a closed position, said first sealing surface disposed in operable sealed contact with said first valve seat for substantially sealing off the conduit portion and preventing flow therethrough when said valve means is in its closed position, a chamber surrounding said valve means, spring means biasing said valve means into said open position away from said first valve seat, said spring means mounted so that the bias force supplied thereby is in substantially the same direction as the movement of said valve means, said chamber having a mean internal diameter $D_2$, wherein the value of $D_2$ is substantially equal to at least the product of a coefficient C which compensates for impedance to flow therethrough caused by any flow obstructing items and has a value in the range of from 0.50 to 0.99 and the square root of $D^2 + D_1^2$, said first sealing surface and said first valve seat being spaced apart by a distance L when said valve means is biased to its normally open position, wherein L is at least equal to 0.25 D, said spring means and said valve means being so constructed and arranged and the bias of said spring means being so adjusted that when the rate of flow past said valve means is at least equal to a predetermined maximum desired flow rate corresponding to a maximum desired engine speed said valve means automatically moves under influence of the resulting pressure drop thereacross into said closed position in sealed contact with said first valve seat in opposition to the bias applied by said spring means for stopping said engine, said spring means returning said valve means to said normally open position when the engine is stationary and the pressure drop across said valve means is substantially zero.

18. A valve in combination with an internal combustion engine for automatically controlling the maximum speed of said engine, a first conduit portion for forming at least part of the intake passageway of said engine and having at least a first valve seat, the said first conduit portion including the said first valve seat having a minimum effective internal diameter of D, which comprises the product of a coefficient C having a value in the range of 0.50 to 0.99 multiplied by four times the unobstructed flow area of said first conduit divided by the total perimeter of said unobstructed flow area, said coefficient compensating for the impedance to flow therethrough caused by any flow obstructing items, movably mounted valve means having at least a first sealing surface and operable as a function of pressure differential and having a mean diameter $D_1$, support means for mounting said valve means for movement between a normally open position and a closed position, said valve means including a second sealing surface opposite said first sealing surface, said valve means being located between an upstream valve seat and a downstream valve seat comprising said first valve seat with which a respective one of said first and second sealing surfaces can engage to block flow through said first conduit portion, said first sealing surface disposed in operable sealed contact with said first valve seat for substantially sealing off the first conduit portion and preventing flow therethrough when said valve means is in its closed position, a chamber surrounding said valve means, said chamber having a mean internal diameter $D_2$ wherein the value of $D_2$ is substantially at least equal to the product of the square root of $D^2 + D_1^2$ and a coefficient $C_1$ having a value between 0.50 and 0.99, said coefficient $C_1$ providing compensation for the impedance to flow therethrough caused by any flow obstructing items, said valve means being mounted to said chamber for movement substantially parallel to the direction of flow through said first conduit portion, said first and second sealing surfaces being spaced a predetermined distance L from a corresponding one of said first and second valve when said valve means is biased to its normally open position, wherein L is at least equal to 0.25D, spring means biasing said valve means into said normally open position away from said first valve seat, said spring means and said valve means being so constructed and arranged and the bias of said spring means being so adjusted that when the rate of flow past said valve is at least equal to a predetermined maximum desired flow rate corresponding to a maximum desired engine speed said valve means automatically moves under the influence of the resulting pressure drop thereacross into said closed position in sealed cooperation with said first valve seat in opposition to the bias applied by said spring means for stopping said engine, said spring means returning said valve means to said open position when the engine is stationary and the pressure drop across said valve means is substantially zero.

19. The combination of claim 10 including adjusting means for adjusting the amount of bias applied by said spring means to said valve means and being substantially inaccessible when operatively assembled with said engine.

20. The combination of claim 19 wherein said adjusting means is located within the flow path of said engine.

* * * * *